US006897079B2

(12) United States Patent
Hirose et al.

(10) Patent No.: US 6,897,079 B2
(45) Date of Patent: May 24, 2005

(54) METHOD OF DETECTING AND MEASURING ENDPOINT OF POLISHING PROCESSING AND ITS APPARATUS AND METHOD OF MANUFACTURING SEMICONDUCTOR DEVICE USING THE SAME

(75) Inventors: Takenori Hirose, Machida (JP); Mineo Nomoto, Yokohama (JP); Hiroyuki Kojima, Kawasaki (JP); Hidemi Sato, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/800,495

(22) Filed: Mar. 8, 2001

(65) Prior Publication Data

US 2002/0127950 A1 Sep. 12, 2002

(30) Foreign Application Priority Data

Oct. 18, 2000 (JP) ..... 2000-318202

(51) Int. Cl.[7] ..... H01L 21/66; H01L 21/302
(52) U.S. Cl. ..... 438/16; 438/18; 438/692
(58) Field of Search ..... 438/692, 161, 438/1.8, 16, 18, 14

(56) References Cited

U.S. PATENT DOCUMENTS 5,413,941 A * 5/1995 Koos et al. ..... 438/16
5,663,797 A * 9/1997 Sandhu ..... 438/16
5,695,601 A * 12/1997 Kodera et al. ..... 156/636.1
5,770,521 A * 6/1998 Pollock ..... 438/692
5,838,447 A * 11/1998 Hiyama et al. ..... 356/381
5,838,448 A * 11/1998 Aiyer et al. ..... 356/382
5,954,975 A * 9/1999 Cadien et al. ..... 216/38
5,964,643 A 10/1999 Birang et al.
6,190,234 B1 * 2/2001 Swedek et al. ..... 451/6
6,425,801 B1 * 7/2002 Takeishi et al. ..... 451/5

FOREIGN PATENT DOCUMENTS

JP 9-285955 11/1997
JP 10-233374 9/1998
JP 2000-009437 1/2000
JP 2000-310512 11/2000

OTHER PUBLICATIONS

Japanese Patent Unexamined Publication No. 9–7985 (U.S. Appl. No. 5,964,643).

* cited by examiner

*Primary Examiner*—Nadine G. Norton
*Assistant Examiner*—Lynette T. Umez-Eronini
(74) *Attorney, Agent, or Firm*—Antonelli, Terry, Stout & Kraus, LLP

(57) ABSTRACT

Laser sources output laser lights $L_1$ and $L_2$ having different wavelengths so as to increase an accuracy of an endpoint detection of polishing processing by enabling an accurate detection of a film thickness of a layer insulating film on a surface of a wafer to be polished by the CMP processing, the lights are emitted from a detection window via a beam splitter to the layer insulating film formed on the surface of the wafer to be polished by a pad, different optical detectors detect interference lights corresponding to the laser lights $L_1$ and $L_2$ reflected and generated from a surface of the layer insulating film and a pattern under the surface via the detection window, the beam splitter, and a dichroic mirror, the detection results are supplied to a film thickness evaluation unit 7, a film thickness of the layer insulation film is detected on the basis of a relationship between intensities of the reflected interference lights to the laser lights $L_1$ and $L_2$ or the intensity ratio, and an endpoint of polishing processing is determined when the film thickness is equal to a predetermined value.

12 Claims, 11 Drawing Sheets

METHOD OF DETECTING AND MEASURING ENDPOINT OF POLISHING PROCESSING AND ITS APPARATUS AND METHOD OF MANUFACTURING SEMICONDUCTOR DEVICE USING THE SAME

BACKGROUND OF THE INVENTION

1. Field of the Invention

The present invention relates to an endpoint detecting of polishing processing of a semiconductor device, and more particularly to a method of detecting an endpoint in smoothing of a wafer surface and its apparatus, a polishing method with an endpoint detecting function and its apparatus, and a method of manufacturing a semiconductor device using the same.

2. Related Background Art

A semiconductor device is manufactured by forming a film on a silicon wafer (hereinafter simply referred to as wafer) and forming an element or wiring pattern through an exposure in a desired pattern and an etching process of the exposed portion. Subsequently to forming the element or wiring pattern as described above, a transparent layer insulating film made of $SiO_2$ or the like is formed to cover the element or wiring pattern and the next element or wiring pattern is formed on the layer insulating film, thus causing the manufactured semiconductor device to have a laminated structure.

In order to form an element or wiring pattern on a certain layer on a wafer and a layer insulating film so as to cover it and further to form an element or wiring pattern as the next layer on this layer insulating film, an exposure light focusing condition (an exposure condition) must be uniform over the entire film. The under element or wiring pattern, however, generates an uneven surface of the layer insulating film provided to form the next layer on the element or wiring pattern layer on the wafer. Particularly in recent years, a pattern formed on the wafer tends to have a more fine-grained and multi-layered structure so as to achieve a high-precision and high-density semiconductor device, thereby increasing the unevenness on the surface of the layer insulating film to be formed. The increase of the unevenness on the surface of the layer insulating film makes it hard to achieve a uniform exposure condition over the entire film formed on the layer insulating film, and therefore the layer insulating film is smoothed before forming the film.

For this smoothing processing, there is conventionally used a method of realizing a smooth film by polishing a surface by means of chemical and physical effects (CMP: Chemical mechanical polishing). This CMP processing is described below by using FIG. 20.

In this diagram, a pad 1 is provided on a surface of a polishing disk 2 in a polishing machine to be used. The pad 1 is a sheet made of porous hard sponge material having fine holes on its surface. The polishing disk 2 is rotated and slurry 5 which is fluid abrasive including fine abrasive grains is added and applied on a surface of the pad 1. Then, a wafer not shown in a wafer chuck 3 is pressed to the pad 1, thereby causing a layer insulating film on the surface of the wafer to be polished by the pad 1.

It should be noted here that a rotary speed is different between a central portion of the rotating polishing disk 2 and its surrounding portion and therefore the wafer chuck 3 is moved in a radial direction of the polishing disk 2 or rotated so that the entire layer insulating film on the wafer is polished to have a uniform film thickness. This polishing is performed by abrasive grains of the slurry 5 getting into fine holes of the pad 1 to be held therein. If a lot of wafers are polished, however, the pad 1 wears out on its surface, thereby decreasing a polishing performance of the pad 1 or causing a serious condition in which the layer insulating film on the wafer surface has flaws due to contaminants adhering to the surface of the pad 1. Accordingly, a dresser 4 is provided to shave the surface of the pad 1 for a regeneration of the pad surface.

The CMP processing is as set forth in the above. As an important problem in this CMP processing, there is an endpoint detection for terminating polishing when the layer insulating film on the wafer surface has been polished into a predetermined film thickness. The endpoint detection in the CMP processing has been controlled initially by calculating a processing time based on a previously evaluated polishing rate or by detaching the wafer from the CMP processing machine whenever polishing has been performed for a predetermined time and directly measuring a film thickness of the layer insulating film. In these methods, however, the detection cannot be precisely controlled due to uneven polishing rates and further the control takes plenty of time.

To solve these problems, there is disclosed an in-situ measuring system capable of an endpoint detection on an actual wafer by measuring a film thickness of a layer insulating film while polishing it in Japanese Patent Unexamined Publication No. 9-7985.

As shown in FIG. 20, this system is provided with a detection window 6 penetrating the polishing disk 2 and the pad 1, so that the layer insulating film on the wafer surface is irradiated with a laser light having a single wavelength from the detection unit 8 via the detection window 6, the detection unit 8 detects an interference light between a reflected light from the surface of the layer insulating film and a reflected light from a pattern formed under the layer insulating film, and the film thickness evaluation unit 7 detects a variation of a film thickness of the layer insulating film based on a variation P of a detected intensity of the interference light, thereby enabling an endpoint detection of polishing processing.

Referring to FIG. 21, there is shown a detected intensity variation P of the interference light detected by the detection unit 8 in FIG. 20, the detected intensity variation periodically changing as shown in the graph. The maximum amplitude of the interference light in this condition depends upon the layer insulating film formed on the wafer surface and a reflectance of the pattern, a period of the interference light depends upon a wavelength of the emitted laser light, a film thickness of the layer insulating film, and a refractive index of a film material, and an amplitude of the interference light varies with a change of a distance between the surface of the layer insulating film under polishing processing and a pattern surface of the previous layer immediately under the layer insulating film (in other words, a film thickness of the layer insulating film). Therefore, assuming an interference light intensity I at time t, the layer insulating film has a film thickness causing an interference light of the intensity I.

Therefore, a focus can be detected by previously calculating or evaluating in an experiment the interference light intensity I at which the film thickness of the layer insulating film is a predetermined thickness which is an endpoint of the CMP processing (in other words, the entire surface of the layer insulating film is uniformly smoothed), by measuring the interference light intensity with the film thickness evaluation unit 7 during the CMP processing of the wafer as described with referring to FIG. 20, and by determining an endpoint of the CMP processing when the measured intensity becomes equal to the predetermined intensity I.

The interference light intensity varies as indicated by the curve P in FIG. 21 with a progression of polishing the layer insulating film on the wafer surface. This intensity variation P with an elapsed time shows a slow movement. Therefore, a gradient of the curve P is low and therefore even if a predetermined intensity I is detected, it is hard to detect it accurately. Accordingly the conventional in-situ measurement is effective for a relatively large processing amount (polishing amount), while it is often incapable of detecting an endpoint accurately in case of a small processing amount or according to a film structure.

SUMMARY OF THE INVENTION

The present invention has been made to solve the above problem. And, there is provided a method and an apparatus for detecting an endpoint of polishing processing enabling an accurate processing endpoint detection independently of a polishing processing amount or a film structure, a polishing method provided with an endpoint detection function and its apparatus, and a method of manufacturing a semiconductor device.

In other words, in accordance with a first aspect of the present invention, there is provided a method and an apparatus for detecting an endpoint of polishing processing, wherein the film formed on a wafer surface under polishing processing is irradiated with lights having two or more different wavelengths, a white light or an ultraviolet (UV) light, and a film thickness of the film formed on the semiconductor device surface is evaluated based on an intensity of a reflected light or a spectral intensity from the film or an intensity of the UV light, thereby detecting an endpoint of polishing processing for the film. According to these method and apparatus, it is possible to increase an accuracy of detecting the endpoint of polishing processing for the film even for a small polishing processing amount or independently of a film structure.

In a second aspect of the present invention, there is provided a polishing processing method with an endpoint detection function and its apparatus, wherein the film formed on a wafer surface under polishing processing is irradiated with lights having two or more different wavelengths, a white light or an ultraviolet (UV) light, and a film thickness of the film formed on the semiconductor device surface is evaluated based on an intensity of a reflected light or a spectral intensity from the film or an intensity of the UV light, thereby detecting an endpoint of polishing processing for the film to terminate the polishing processing. According to these method and apparatus, it is possible to increase an accuracy of detecting the endpoint of polishing processing for the film even for a small polishing processing amount or independently of a film structure.

In accordance with a third aspect of the present invention, there is provided a method of manufacturing a semiconductor device, wherein means for evaluating the film thickness is incorporated into a polishing processing machine to evaluate a deteriorated condition of a polishing pad, thereby optimizing the polishing processing conditions and dressing conditions of the pad at the polishing processing. With this method, an object to be polished, for example, a film formed on the wafer becomes further smoother, thus enabling a high-precision film thickness control or a high-grade polishing processing control to improve a throughput.

The semiconductor device manufacturing method according to the present invention may be such that the condition is evaluated at a plurality of positions on the wafer surface by pad evaluation means, thereby enabling an evaluation of a film thickness distribution of a wafer and a film on the wafer surface during processing.

In addition the semiconductor device manufacturing method according to the present invention may be such that a CMP process can be stabilized and optimized on the basis of a film evaluation result of the film formed on the wafer surface.

Furthermore, in accordance with a fourth aspect of the present invention, there is provided a polishing processing machine, comprising polishing means for polishing a film formed on a wafer surface, irradiation means for irradiating the film formed on the wafer surface during the polishing with the above light or UV light, detection means for detecting a reflected light or the UV light from the film formed on the wafer surface, and a processor circuit section for evaluating a film thickness of the film formed on the wafer surface on the basis of an intensity of the reflected light detected by the detection means, a spectral intensity, or an intensity of the UV light.

These and other objects, features and advantages of the invention will be apparent from the following more particular description of preferred embodiments of the invention, as illustrated in the accompanying drawings.

DETAILED DESCRIPTION OF THE PREFERRED EMBODIMENTS

The present invention will be described below with reference to the accompanying drawings. While the CMP processing described in FIG. 20 is assumed in embodiments described below, the present invention is not limited to it.

Figure 1:
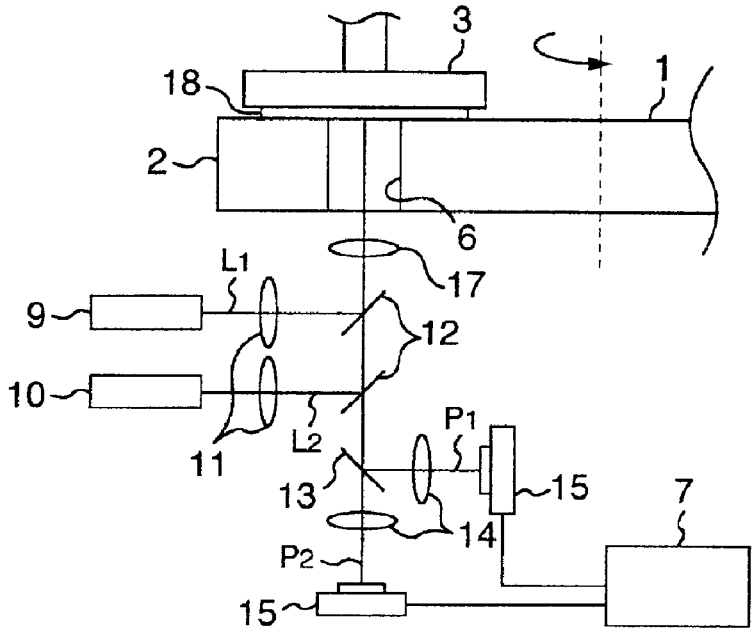
FIG. 1 is a constitutional view of a first embodiment of a method and an apparatus for detecting an endpoint of polishing processing according to the present invention.
Figure 20:
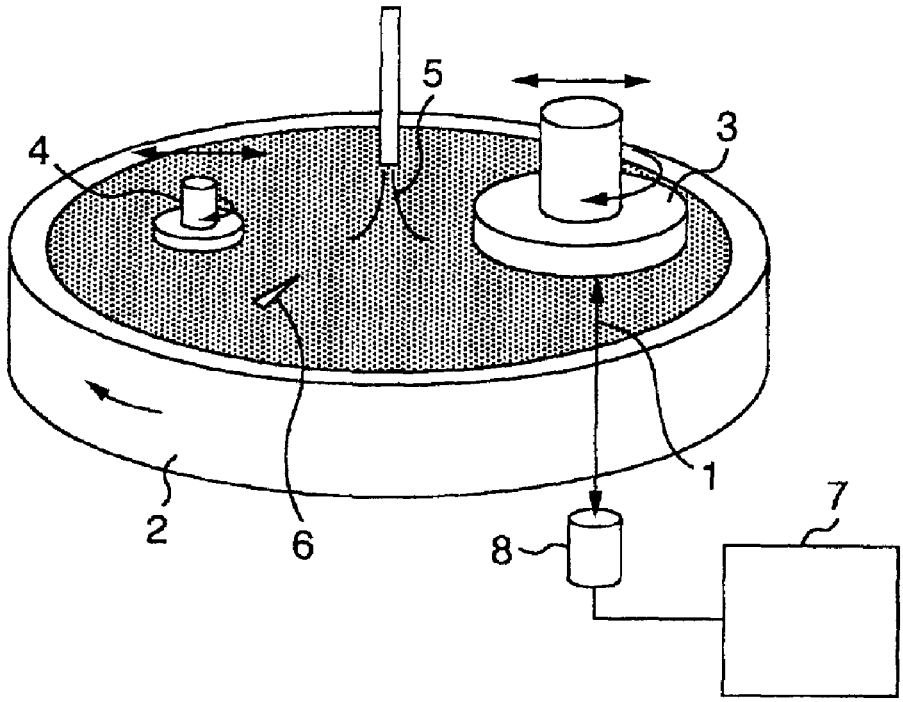
FIG. 20 is a diagram showing an example of a CMP polishing processing.
Figure 21:
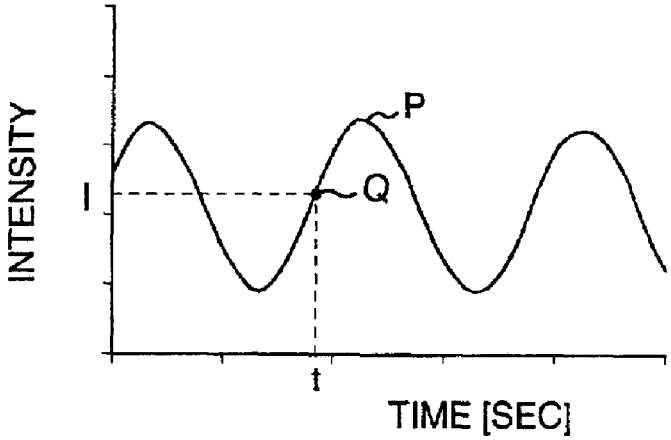
FIG. 21 is a diagram showing a conventional endpoint detection method in the CMP processing shown in FIG. 20.

Referring to FIG. 1, there is shown a constitutional diagram of a main portion of a first embodiment of a method and an apparatus for detecting an endpoint of polishing processing according to the present invention, including laser light sources 9 and 10, a lens 11, a beam splitter 12, a dichroic mirror 13, a lens 14, optical detectors 15 and 16, an objective lens 17, and a wafer 18, where identical reference numerals are used for the portions corresponding to those in FIG. 20 to omit overlapped descriptions.

In this figure, the laser light sources 9 and 10 emits laser lights $L_1$ and $L_2$ having different wavelengths. These laser lights $L_1$ and $L_2$ are changed to beams by the lens 11, reflected on the beam splitter 12, and then emitted to the wafer 18 held by a wafer chuck via the objective lens 17 and the detection window 6 provided penetrating the polishing disk 2 and the pad 1 from the side of a layer insulating film (not shown). In this condition, the laser lights $L_1$ and $L_2$ reflected on the beam splitter 12 from the laser light sources 9 and 10 need not be always on an identical optical axis.

Interference lights $P_1$ and $P_2$ for each of the laser lights $L_1$ and $L_2$ generated by the above reflection from the wafer 18 pass through the detection window 6, the objective lens 17, and the beam splitter 12 and then separated by the dichroic mirror 13 according to the wavelength. In other words, the interference light $P_1$ caused by the laser light $L_1$ from the laser light source 9 is, for example, reflected by the dichroic mirror 13 and detected by the optical detector 15 via the lens 14. The interference light $P_2$ caused by the laser light $L_2$ from the laser light source 10 is, for example, transmitted through the dichroic mirror 13 and detected by the optical detector 16 via the lens 14. The film thickness evaluation unit 7 controls the polished condition of the wafer 18 on the basis of detection outputs of the optical detectors 15 and 16 to detect an endpoint of the polishing.

In the above configuration, the laser light sources 9 and 10, the lenses 11 and 14, the beam splitter 12, the dichroic mirror 13, the optical detectors 15 and 16, and the objective lens 17 form the detection unit 8 shown in FIG. 20. It is the same in other embodiments as hereinafter described.

Figure 2:
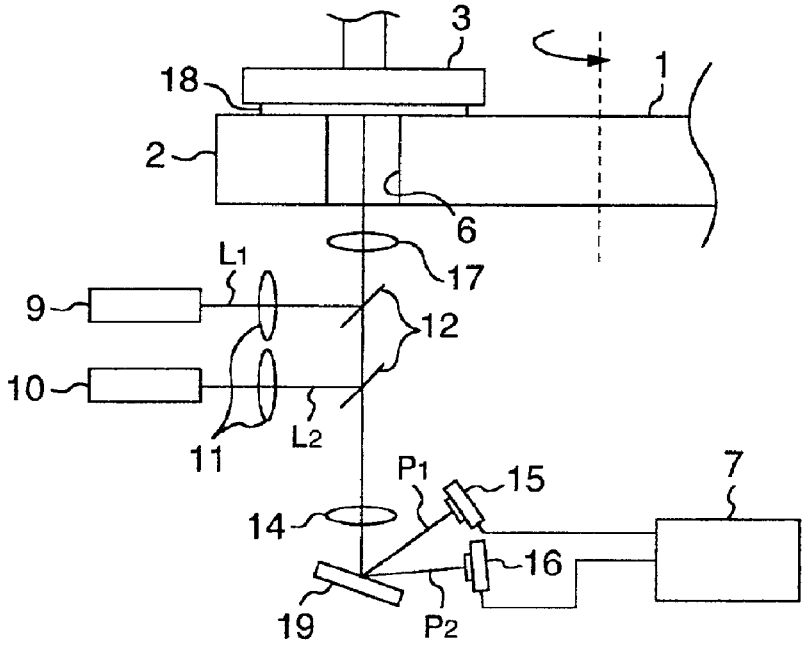
FIG. 2 is a constitutional view of a second embodiment for detecting an endpoint of polishing processing according to the present invention.

While the interference lights $P_1$ and $P_2$ caused by the laser lights $L_1$ and $L_2$ having different wavelengths are separated by using the dichroic mirror 13 in the embodiment shown in FIG. 1, they can be separated by using a diffraction grating 19 as shown in FIG. 2 as a second embodiment. Furthermore, it is also possible to use other wavelength separating means such as a prism other than the above.

Furthermore, as the optical detectors 15 and 16 in FIG. 1 and FIG. 2, it is possible to use a CCD two-dimensional sensor or one-dimensional line sensor or other optical sensors other than the CCD sensors.

If the single detection window 6 is provided on the polishing disk 2 and the wafer 18 is located on an extension line of the optical axis of the objective lens 17 in FIG. 1 and FIG. 2, the optical detectors 15 and 16 detect the interference lights $P_1$ and $P_2$ intermittently once per rotation of the polishing disk 2. These interference lights $P_1$ and $P_2$ are not always needed for detecting a film thickness of the layer insulating film to be polished on the surface of the wafer 17.

Figure 3:
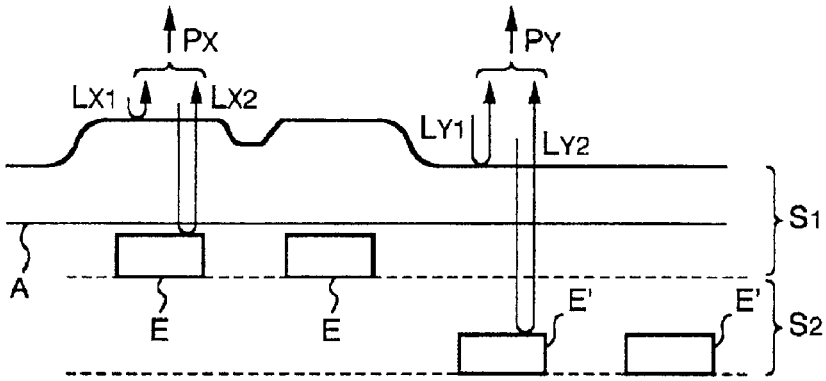
FIG. 3 is a diagram schematically showing an occurrence of an interference light from a multi-layered wafer.

Namely, in FIG. 3 it is assumed that $S_2$ designates a layer insulating film formed at the previous time, a pattern E is formed on the layer insulating film $S_2$, a layer insulating film $S_1$ is formed so as to cover it, and the layer insulating film $S_1$ is to be polished to the thickness indicated by a long and short dash line A. In the embodiments shown in FIG. 1 and FIG. 2 (also in other embodiments described later), there are detected not only an interference light $P_X$ between a light $L_{X1}$ reflected on the surface of the layer insulating film $S_1$ and a light $L_{X2}$ reflected on the surface of patterns E in the layer insulating film $S_1$, but also an interference light $P_Y$ between a light $L_{Y1}$ reflected on the surface of the layer insulating film $S_1$ and a light $L_{Y2}$ reflected on the surface of patterns E' in the layer insulating film $S_2$.

Figure 4:
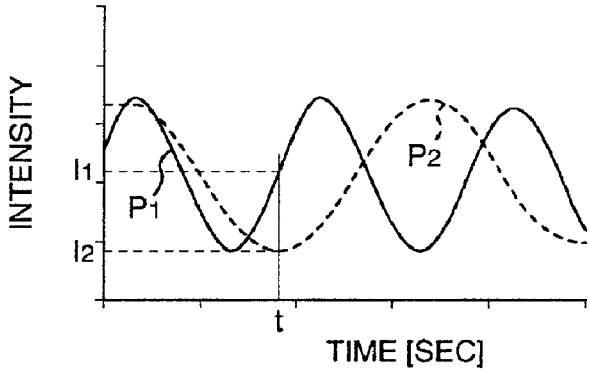
FIG. 4 is a diagram showing a concrete example of a method of detecting an endpoint of polishing processing in the embodiments shown in FIGS. 1 and 2.

Referring to FIG. 4, there is shown a diagram of a concrete example of a method of detecting an endpoint of polishing processing using the film thickness evaluation unit 7 shown in FIG. 1 and FIG. 2.

The film thickness evaluation unit 7 is provided with a detection result of the optical detectors 15 and 16. The detection results are as shown in FIG. 4. Namely, a curve (indicated by a solid line) $P_1$ represents an intensity variation of the interference light $P_1$ caused by the laser light $L_1$ from the laser light source 9 and a curve (indicated by a dashed line) $P_2$ represents an intensity variation of the interference light $P_2$ caused by the laser light $L_2$ from the laser light source 10; where the laser light $L_2$ from the laser light source 10 is assumed to have a longer wavelength than that of the laser light $L_1$ from the laser light source 9. Therefore, the interference lights $P_1$ and $P_2$ have intensities different from each other to the film thickness of the layer insulating film on the surface of the wafer 18 in general.

Therefore, the film thickness evaluation unit 7 previously determines intensities $I_1$ and $I_2$ of the interference lights $P_1$ and $P_2$ at the endpoint of polishing processing at which the layer insulating film thickness is equal to a predetermined value as a result of the calculation or experiment and determines an endpoint t of the polishing processing when the interference light $P_1$ has the intensity $I_1$ as a detection result of the optical detector 15 and the interference light $P_2$ has the intensity $I_2$ as a detection result of the optical detector 16.

An endpoint cannot be accurately detected as described in the prior art when an endpoint is detected using the interference light $P_1$ singly or the interference light $P_2$ singly, while the accuracy of the endpoint detection is increased due to compensation for a detection error between them when the interference lights $P_1$ and $P_2$ are combined with each other so as to determine the endpoint of polishing processing when their intensities get equal to the predetermined intensities $I_1$ and $I_2$ at the same time as shown in this embodiment.

As set forth in the above, the endpoint of polishing processing can be accurately detected in this embodiment. Therefore, the endpoint of polishing processing can be accurately detected even for a small polishing amount independently of a film structure in the wafer 18.

While two laser light sources 9 and 10 are provided as light sources and laser lights $L_1$ and $L_2$ having two different wavelengths are used in this embodiment, it is possible to use three or more laser light sources and laser lights having three or more types of wavelengths and an endpoint of polishing processing can be detected with a combination of intensities of interference lights of these laser lights.

When the endpoint of the processing is detected, the rotation of the polishing disk 2 is stopped and the wafer chuck 3 stops the pad 1 from pressing the wafer to the polishing disk 2.

In this manner, the wafer can be precisely polished by accurately detecting the endpoint of polishing processing and stopping the polishing processing.

Figure 5:
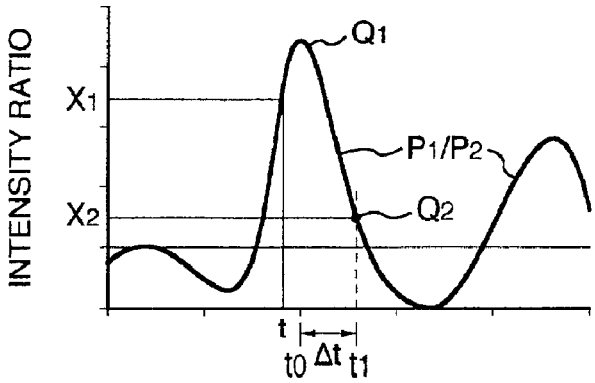
FIG. 5 is a diagram showing another concrete example of a method of detecting an endpoint of polishing processing in the embodiments shown in FIGS. 1 and 2.

Referring to FIG. 5, there is shown another embodiment of a method of detecting an endpoint of polishing processing with the film thickness evaluation unit 7 shown in FIG. 1 and FIG. 2.

In this embodiment, a ratio of a detection result from the optical detector 15 to one from the optical detector 16 is determined and an endpoint of polishing processing is detected based on the ratio.

Namely, while the intensities of the interference lights $P_1$ and $P_2$ shown in FIG. 4 are obtained also in this embodiment, further the intensity ratio $P_1/P_2$ is determined and an endpoint t of the polishing processing is determined when the intensity ratio $P_1/P_2$ is equal to a value $X_1$ of a film thickness obtained by a calculation or an experiment.

In this case, the intensity ratio $P_1/P_2$ obtained from the interference lights $P_1$ and $P_2$ shown in FIG. 4 is represented by a characteristic curve including steep rise and fall portions and moderate rise and fall portions as shown in FIG. 5. In this embodiment, naturally the endpoint is detected in the steep rise and fall portions and therefore it is only required to use laser lights $L_1$ and $L_2$ having wavelengths satisfying the condition.

This makes it possible to detect the endpoint of polishing processing in the steep characteristic portions, thereby enabling a very accurate endpoint detection. Therefore, a high-precision polishing processing is achieved.

In addition, the interference light intensities detected by the optical detectors 15 and 16 depend upon the type of the wafer 18 to be polished. As described later, a transparent material can be used for the pad 1 and in this case there is no need for providing a penetrating hole for the detection window 6, but a change of a surface condition of the pad 1 caused by continuous polishing processing may change the optical transmitting condition there, thereby changing the intensities of the interference lights detected by the optical detectors 15 and 16. Furthermore, as described later, a transparent plate is provided in the detection window 6 so as to prevent the slurry 5 (FIG. 20) from leaking out from the detection window 6 to the optical system including the objective lens 17, and an optical transmittance may be decreased due to remains of the slurry 5 on the transparent plate, thereby causing a change of the intensities of the interference lights detected by the optical detectors 15 and 16. As shown in FIG. 5, however, if the endpoint of polishing processing is detected based on the intensity ratio $P_1/P_2$ of the interference lights $P_1$ and $P_2$, these effects are canceled and avoided by taking a ratio.

While the endpoint t of polishing processing is determined when the intensity ratio $P_1/P_2$ has reached the directly preset value $X_1$in the embodiment shown in FIG. 5, if the endpoint $t_1$ is determined at a point $Q_2$ at which the intensity ratio $P_1/P_2$ passing the peak point $Q_1$ of the intensity ratio $P_1/P_2$ is equal to the directly preset value $X_2$, it is also possible to previously determine a time $\Delta t$ from the peak point $Q_1$ to the point $Q_2$ in a calculation or an experiment, to measure the time $\Delta t$ from the peak point $Q_1$ detected time when the peak point $Q_1$ of the intensity ratio $P_1/P_2$ is detected (time $t_0$), and to determine the endpoint $t_1$ of polishing processing. In this case, the characteristic curve of the intensity ratio $P_1/P_2$ is steep and therefore the peak point $Q_1$ can be accurately detected.

In addition, it is possible to detect an arbitrary point in the steep rise or fall portion of the intensity ratio $P_1/P_2$ in the characteristic curve instead of the peak point $Q_1$ and to consider the time point at which a predetermined time has been elapsed from the detected point as the endpoint of polishing processing.

Furthermore, in the same manner also in the embodiment shown in FIG. 4, it is possible to previously obtain predetermined intensities $I_1$ and $I_2$ of the interference lights $P_1$ and $P_2$ at a time point previous to the endpoint of the polishing processing and the time $\Delta t$ from a time point when these intensities are concurrently detected to the endpoint of the polishing processing and to consider the time point at which the time $\Delta t$ has been elapsed since the intensities $I_1$ and $I_2$ were concurrently detected as the endpoint of polishing processing.

As set forth in the above, the endpoint of polishing processing can be accurately detected also in this embodiment. Therefore, the endpoint of polishing processing can be accurately detected even for a small polishing amount independently of a film structure in the wafer 18, thus enabling high-precision polishing processing with a film thickness precisely controlled.

Furthermore, a device having a multi-layer wiring structure can be achieved at a high yield by the accurate endpoint detection and the film thickness control of the layer insulating film for polishing processing. Namely, for the polished wafer 18, the polished layer insulating film is machined to make a fine hole to expose a part of a wiring film under the layer in the next or subsequent process, a conductive material is embedded into the fine hole, and a new fine pattern is formed on the polished layer insulating film, thereby enabling a stable formation of a wiring pattern connected to a wiring pattern under the layer insulating film.

Then, by using FIGS. 6A and 6B, the processing operation for the above focus detection will be described below.

Figure 6A:
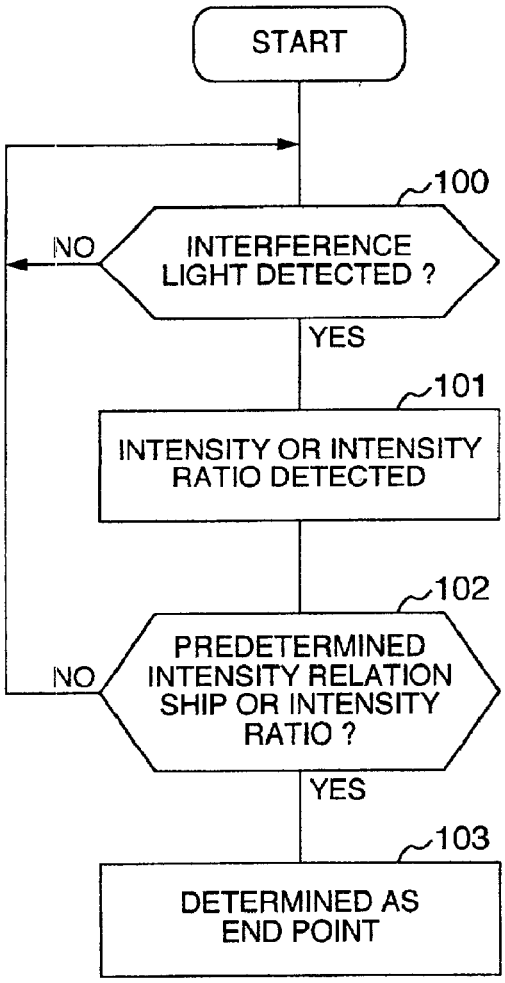
FIGS. 6A and 6B are flowcharts showing an endpoint detecting operation shown in FIGS. 4 and 5.

Referring to FIG. 6A, there is shown a flowchart of a processing operation for the focus detection shown in FIG. 4 or a processing operation for detecting the endpoint t shown in FIG. 5, including steps of detecting interference lights $P_1$ and $P_2$ by using optical detectors 15 and 16 (step 100), after the detection, evaluating the intensities of the interference lights $P_1$ and $P_2$ and determining whether the relationship between them matches the predetermined relationship between $I_1$, and $I_2$ for the endpoint detection (for FIG. 4) or evaluating the intensities of the interference lights $P_1$ and $P_2$ and determining whether the intensity ratio $P_1/P_2$ of the interference lights $P_1$ and $P_2$ matches a predetermined value (for FIG. 5) (steps 101 and 102), and unless the relationship or the value is fulfilled, returning to the step 100 for awaiting the next interference light detection, but otherwise, determining an endpoint of polishing (step 103).

Figure 6B:
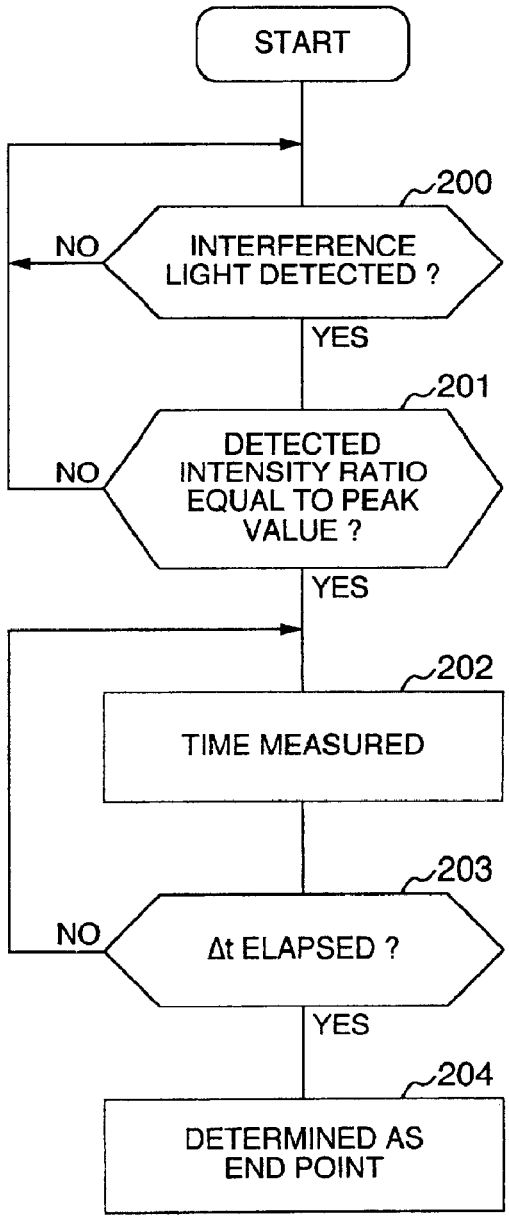

Referring to FIG. 6B, there is shown a flowchart of a processing operation for which an endpoint is assumed to be a time point when a time Δt has been elapsed since the preset peak of the intensity ratio $P_1/P_2$ in FIG. 5, including steps of detecting interference lights $P_1$ and $P_2$ by using optical detectors 15 and 16 (step 200), after the detection, determining whether the intensity ratio $P_1/P_2$ of the interference lights $P_1$ and $P_2$ matches the peak value (step 201), and unless it matches the peak value, returning to the step 200 to await the next interference light detection, but otherwise, starting a time measurement (step 202), awaiting an elapse of time Δt (step 203), and determining an endpoint of polishing (step 204).

In FIG. 4, processing operation is the same as for the operation for FIG. 6B when the detection intensities of the interference lights $P_1$ and $P_2$ concurrently match the preset values $I_l$ and $I_2$ and further polishing processing is continued for the preset time Δt to determine the endpoint of polishing processing.

Figure 7:
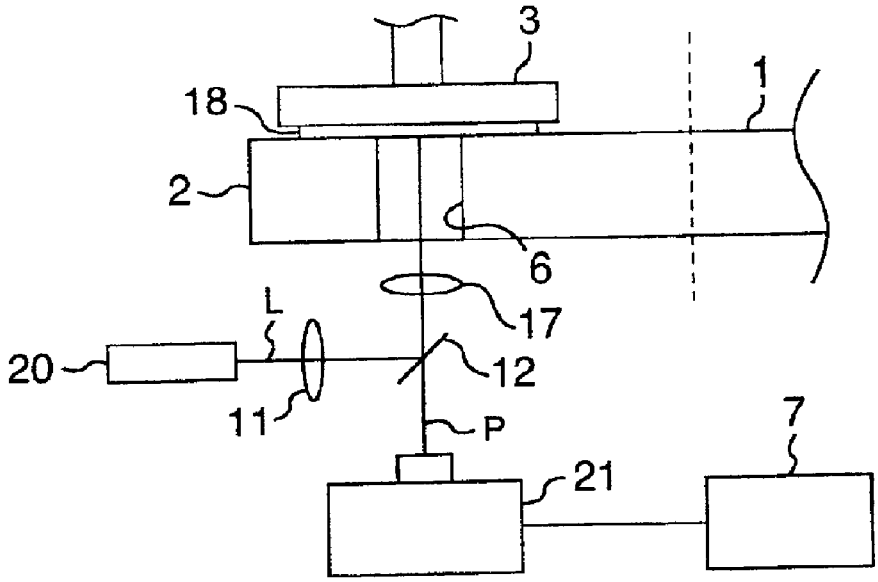
FIG. 7 is a constitutional view of a third embodiment of a method and an apparatus for detecting an endpoint of polishing processing according to the present invention.

Referring to FIG. 7, there is shown a constitutional diagram of a main portion of a third embodiment of a method and an apparatus for detecting an endpoint of polishing processing according to the present invention, including a white light source 20 and a spectrograph 21, with components corresponding to those in the above drawings designated by identical reference numerals to omit overlapped descriptions.

In this third embodiment, a white light source is used for a light source.

In FIG. 7, the white light source 20 emits a white light L. The white light L is changed to beams by a lens 11, reflected on a beam splitter 12, and then emitted to the wafer 18 via an objective lens 17 and a detection window 6 from the side of a layer insulating film (not shown). In this embodiment in the same manner as for the above embodiments, the white light L causes an interference for each wavelength component between a reflected light from a surface of the layer insulating film and a reflected light from a pattern surface under the layer, thereby generating a composite light (hereinafter also referred to as interference light) P of the interference lights. The interference light P passes through the detection window 6, the objective lens 17, and the beam splitter 12 and is detected by the spectrograph 21, by which spectral intensity data of the interference light is obtained for each wavelength. The spectral intensity data is supplied to a film thickness evaluation unit 7 and an endpoint of polishing processing is detected on the basis of the spectral intensity.

In this endpoint detection of polishing processing based on the spectral intensity data, an intensity distribution is previously calculated or obtained in an experiment with intensities of interference lights of each wavelength in the interference light P obtained when a film thickness of the layer insulating film on the surface of the wafer 18 is equal to a predetermined value at which the surface is smoothed, and the endpoint of polishing processing is determined when the intensity distribution of the interference light P based on the spectral intensity data from the spectrograph 21 is equal to the preset intensity distribution.

In this condition, two or more types are arbitrary wavelengths used for detecting an endpoint in the white light L and an endpoint can be accurately detected in the same manner as for the embodiment shown in FIG. 4; naturally the more types of wavelengths are used, the more accurate detection is possible. Naturally it is preferable to use wavelengths different from each other to some extent if there are only a small number of types of wavelengths.

A light source having a wide wavelength band such as a halogen lamp or a xenon lamp can be used as a white light source 20 and an optical sensor other than the CCD sensors such as CCD two-dimensional sensor or one-dimensional line sensor as a detecting section of the interference light P for the spectrograph 21.

Figure 8:
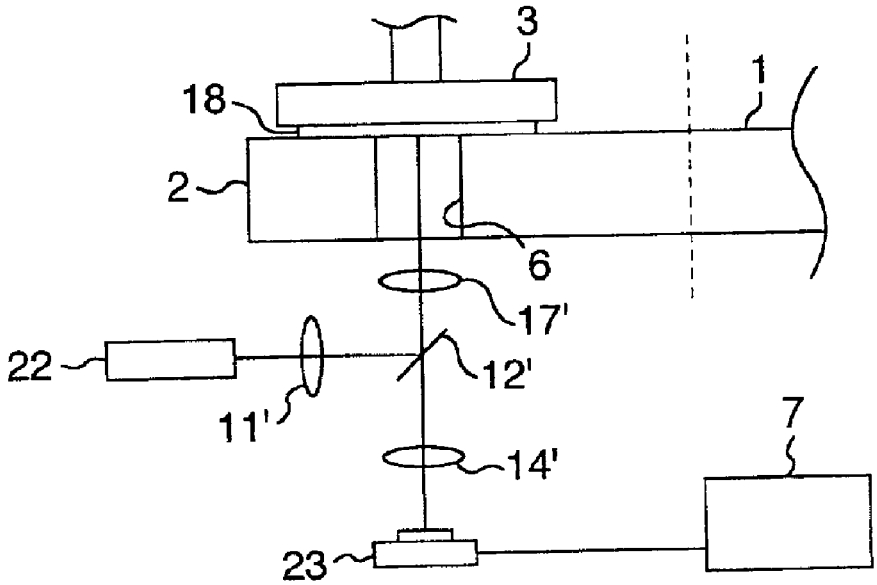
FIG. 8 is a constitutional view of a fourth embodiment of a method and an apparatus for detecting an endpoint of polishing processing according to the present invention.

Referring to FIG. 8, there is shown a constitutional diagram of a main portion of the fourth embodiment of a method and an apparatus for detecting an endpoint of polishing processing according to the present invention, including a UV light lens 11', a UV light beam splitter 12', a UV light objective lens 17', a UV light lens 14', UV light generating means 22, and a UV light detector such as a photomultiplier 23, with components corresponding to those in the above drawings designated by identical reference numerals to omit overlapped descriptions.

In the fourth embodiment, the UV light having a short wavelength is used for a visible light.

In FIG. 8, the UV light generating means 22 emits a UV light. This UV light is changed to beams by the lens 11', reflected on the beam splitter 12', and emitted to the wafer 18 via the objective lens 17' and the detection window 6 from the side of the layer insulating film (not shown). When the UV light is emitted to the layer insulating film, interference is generated in the reflected UV light in the same manner as for the above embodiments. The reflected UV light P' accompanied by interference passes through a detection window, the objective lens 17', and the beam splitter 12' and is detected by a UV light detector 23, by which its intensity data is obtained. The intensity data is supplied to a film thickness evaluation unit 7 and an endpoint of polishing processing is detected on the basis of the intensity.

Figure 9A:
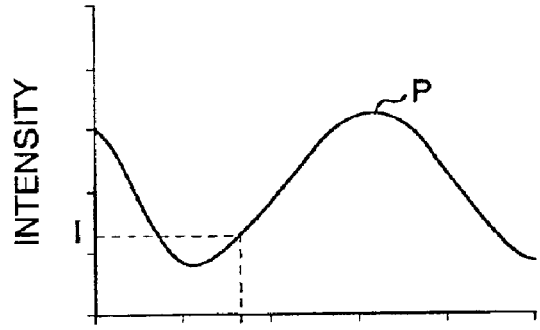
FIGS. 9A and 9B are diagrams showing a variation of a detected intensity in the embodiment shown in FIG. 8 in comparison with a variation of a detected intensity in a conventional technology.
Figure 9B:
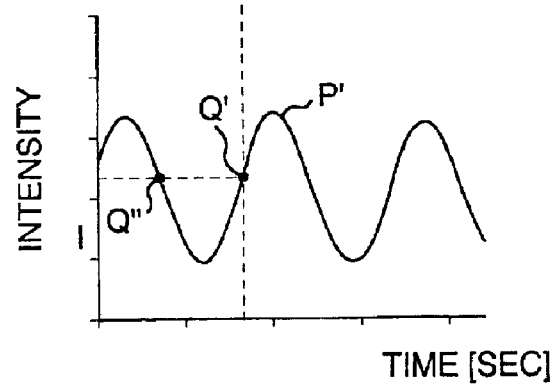

FIG. 9A shows an intensity variation of a reflected light (interference light) P from the film formed on the wafer surface when using a conventional visible light and FIG. 9B shows an intensity variation of a reflected UV light P' obtained by the film thickness evaluation unit 7 in the embodiment shown in FIG. 8. As apparent from a comparison between FIGS. 9A and 9B, the curve in the embodiment shown in FIG. 8 has a relatively short period of the obtained intensity variation and has characteristics of steep inclines or peaks in comparison with the prior art in which a visible light is used, thus enabling an accurate detection of the endpoint of polishing processing. Naturally it is possible to use two endpoint detection methods described in FIG. 5 in this embodiment.

FIG. 9B shows that there is a point Q" of the same intensity as for Q' which is the endpoint of polishing processing before the point Q'. In this case, it is determined by a calculation or an experiment what point should be the endpoint of polishing processing among the points of the intensity I. It is the same in the endpoint detection methods described in FIG. 4 and FIG. 5.

As set forth in the above, a film thickness is evaluated for a film formed on the surface of the wafer 18 during polishing processing for smoothing the layer insulating film formed on the wafer surface, namely during rotation of the polishing disk 2 by using the in-situ measuring system in the embodiments. Therefore, the entire optical system (a portion from the light source to the detector in each embodiment) can be fixed to the polishing disk 2 so as to rotate concurrently with the polishing disk 2 or the optical system can be fixed at a predetermined position independently of the polishing disk 2. Furthermore, there is a method in which only the objective lens 17 is fixed to the polishing disk 2 so as to rotate concurrently with the polishing disk 2. In short, it is only required to irradiate the film formed on the wafer surface with a UV light during polishing processing and to detect its reflected light or reflected UV light.

Optical characteristics of the pad 1 may change during polishing processing of many wafers. Therefore, effects of the change can be reduced by previously evaluating the change amounts and reflecting the changes of the optical characteristics of the pad 1 on the evaluation of the intensities or intensity distribution of the reflected light or the reflected UV light.

Referring to FIGS. 10 to 14, there are shown top plan views of concrete examples of an aperture configuration of a hole (detection hole) forming the detection window 6 provided on the polishing machine.

Figure 10:
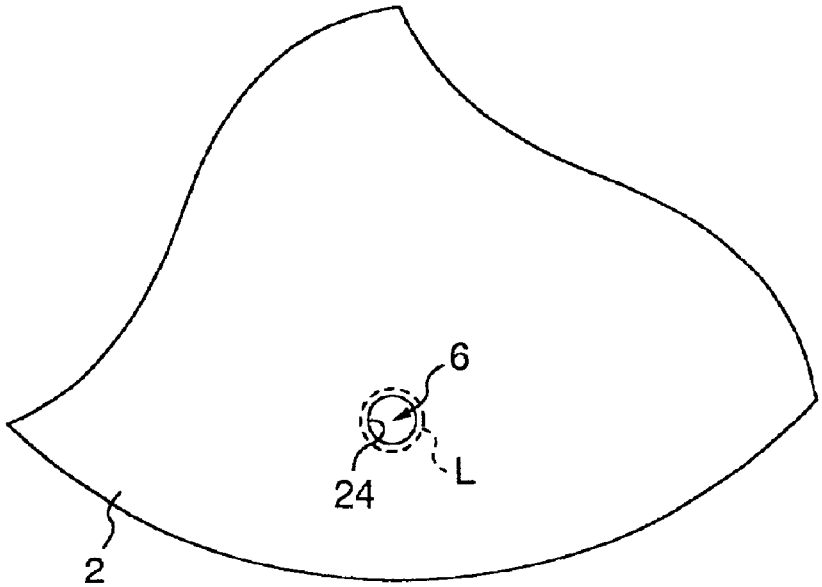
FIG. 10 is a top plan view of a concrete example of an aperture configuration of a detection window provided on a polishing machine in the embodiments described in FIGS. 1 to 9B.
Figure 11:
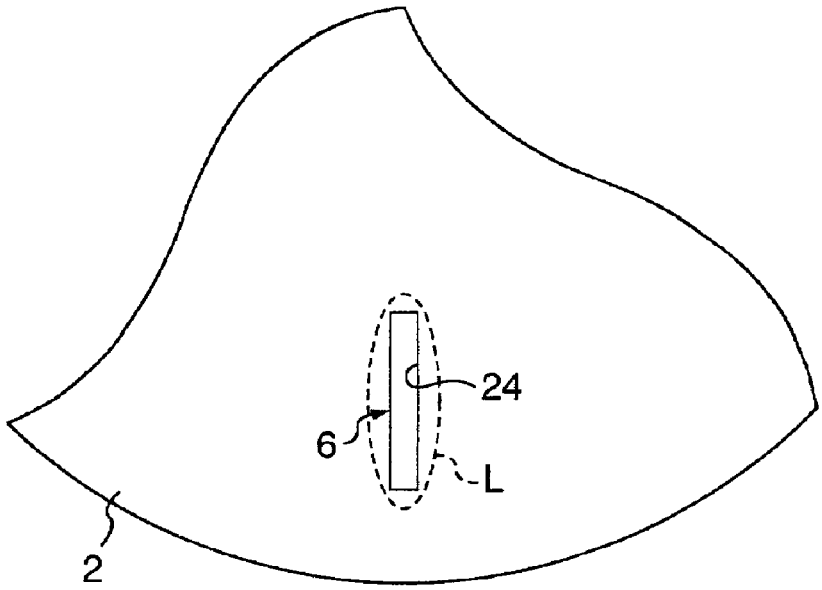
FIG. 11 is a top plan view of another concrete example of an aperture configuration of the detection window provided on the polishing machine in the embodiments described in FIGS. 1 to 9.

As the detection window 6 in the above embodiments, it is possible to provide a single detection hole 24 having a shape of a circular aperture on the polishing disk 2 provided with the pad 1 as shown in FIG. 10 (in this condition, a diameter of an optical beam L from the light source can be shorter than the diameter of the detection hole 24 or can be longer than that as indicated by a dashed line). As shown in FIG. 11, the detection hole can be an aperture having a rectangular shape oblong in a radial direction of the polishing disk 2. In this condition, an optical beam L may have a slit-shaped cross section and the cross section can be larger than the detection hole 24 (if the beam L is larger than the detection hole 24, its cross section can be elliptic). By using these types of optical beam L, it becomes possible to detect an average film thickness in a radial direction of the layer insulating film on the wafer surface and to detect the endpoint more accurately due to a large amount of detected light.

In addition, when using the slit-shaped optical beam L in this manner, the optical beam L is reflected in different positions in a radial direction on the layer insulating film on the wafer surface to be polished, and therefore a film thickness can be detected in the respective positions in the radial direction on the layer insulating film by detecting the reflected slit-shaped interference light using an optical detector having a line sensor. In polishing the layer insulating film on the wafer surface, a polishing amount of the layer insulating film may be uneven in the radial direction depending upon how to apply a pushing pressure to the wafer chuck. This unevenness can be removed, however, by controlling how to apply the pushing pressure to the wafer chuck according to a detection result of the film thickness.

Figure 12:
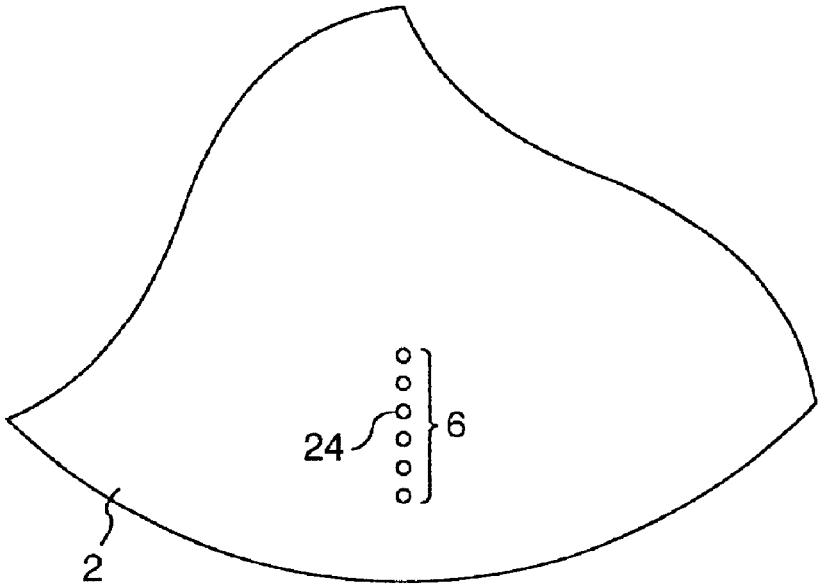
FIG. 12 is a top plan view of still another concrete example of an aperture configuration of the detection window provided on the polishing machine in the embodiments described in FIGS. 1 to 9B.

In a concrete example of the detection window 6 shown in FIG. 12, a plurality of detection holes 24 are arranged in a line in a radial direction on the polishing disk 2. In this example, an optical beam L passes through the respective detection holes 24 and the film thickness can be evaluated in the radial direction of the layer insulating film as is the case with the example shown in FIG. 11. Naturally it is possible to detect an average film thickness in the radial direction of the layer insulating film on the wafer surface likewise with the example shown in FIG. 11 by detecting and summing up a reflected interference light passing through the detection holes 24.

Figure 13:
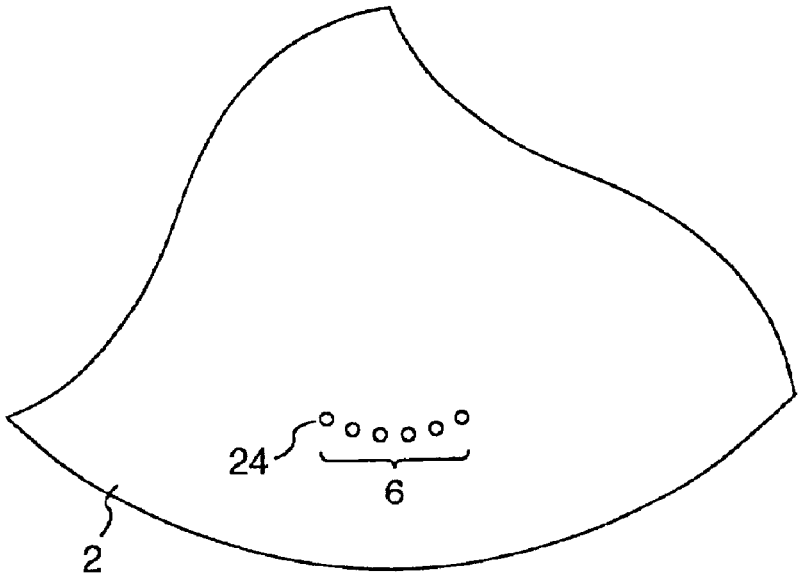
FIG. 13 is a top plan view of further still another concrete example of an aperture configuration of the detection window provided on the polishing machine in the embodiments described in FIGS. 1 to 9B.

In a concrete example of the detection window 6 shown in FIG. 13, a plurality of detection holes 24 are arranged on an identical circumference on the polishing disk 2. Although the detection holes are shown to be arranged on a part of the circumference, actually the holes are arranged at regular intervals on the entire circumference. While the reflected interference light can be detected only once per rotation of the polishing disk 2 when the optical system is fixed in the concrete examples shown in FIG. 10 to FIG. 12, the interference light can be almost always detected when using the detection window 6 shown in FIG. 13. The detection holes 24 can be arc holes each having a predetermined length instead of circular holes.

Figure 14:
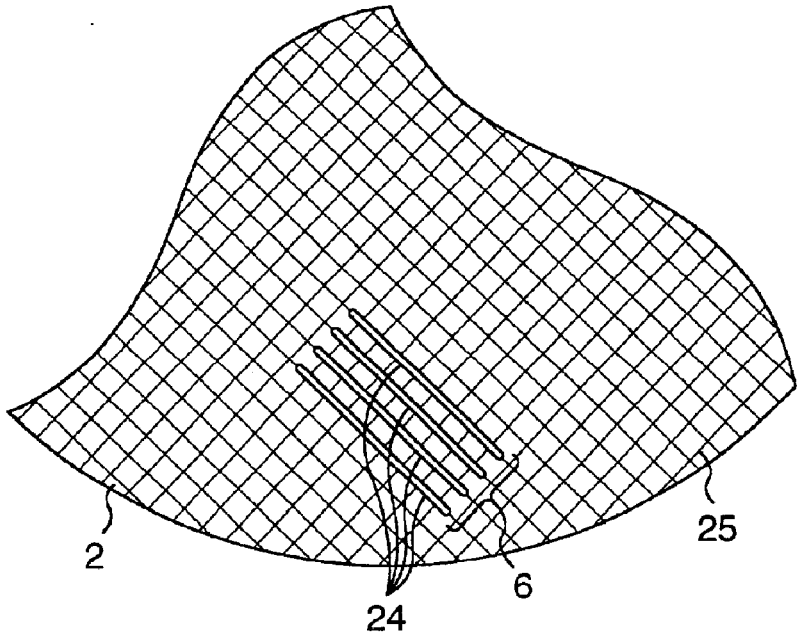
FIG. 14 is a top plan view of still another concrete example of an aperture configuration of the detection window provided on the polishing machine in the embodiments described in FIGS. 1 to 9B.

In addition, a large number of thin grooves 25 crossing at right angles are originally formed on the surface of the pad 1 on the polishing disk 2 as shown in FIG. 14, and it is possible to arrange one or more detection holes 24 as the detection window 6 along a part of the grooves 25. According to it, the detection holes 24 are arranged in a part of the existing grooves 25, thereby sufficiently reducing effects on polishing caused by opening holes on the pad 1, for example, an increase of scratches.

Figure 15:
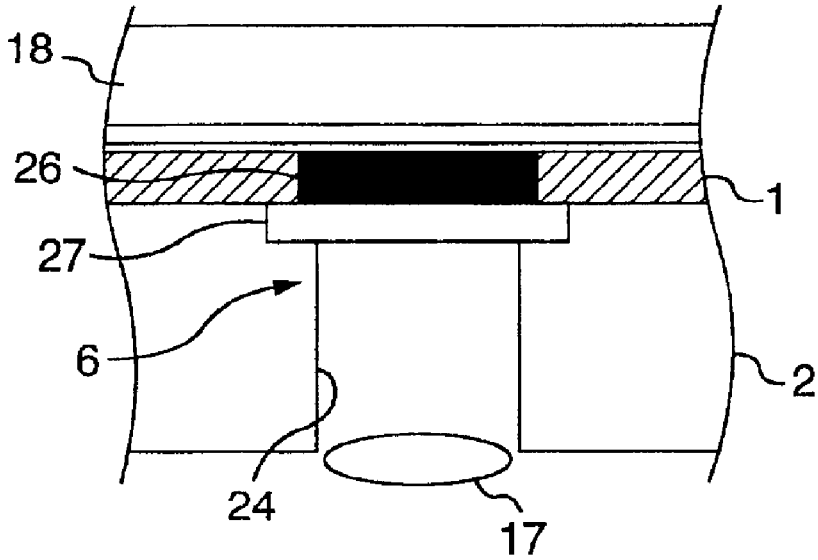
FIG. 15 is a longitudinal sectional view of a concrete example of an internal configuration of the detection window provided on the polishing machine in the embodiments described in FIGS. 1 to 9B.
Figure 16:
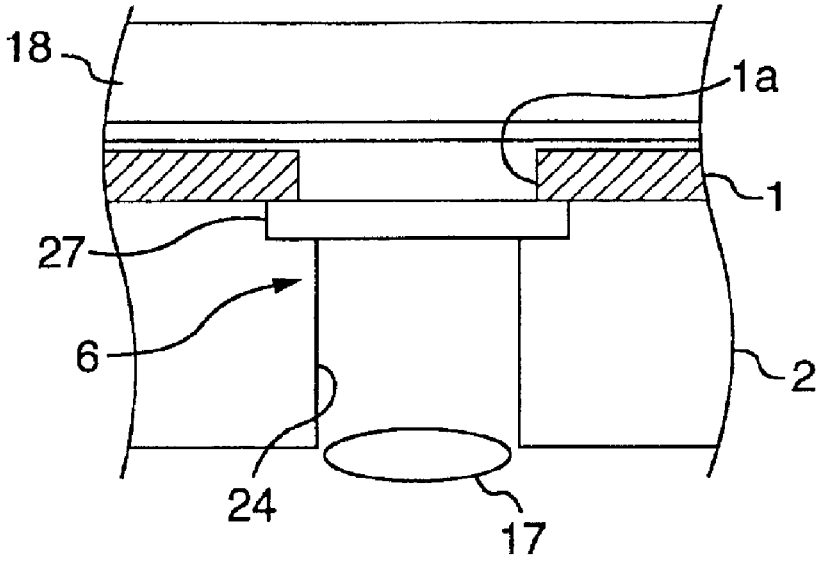
FIG. 16 is a longitudinal sectional view of another concrete example of an internal configuration of the detection window provided on the polishing machine in the embodiments described in FIGS. 1 to 9B.

FIG. 15 and FIG. 16 show concrete examples of an internal structure of the detection window 6 provided on the polishing machine, respectively, including a transparent pad 26 and an optical window 27, with components corresponding to those in the previous drawings designated by identical reference numerals to omit overlapped descriptions.

In the example shown in FIG. 15, the transparent pad 26 is used for the detection window 6 and the optical window 27 covering the detection hole 24 is provided so as to support the transparent pad 26. This optical window 27 is made of a thin glass plate having a certain thickness. The entire pad 1 can be transparent.

Furthermore, as shown in the example in FIG. 16, it is also possible to cut out a part of the pad 1 as a hole portion la corresponding to the detection hole 24 in the detection window 6. In this case, however, slurry 5 (FIG. 20) extended on the pad 1 may remain in the hole portion la on the optical window 27 to decrease the transmittance of the optical window 27, and therefore an outlet of the slurry 5 need be provided to prevent the slurry from flowing into the detection hole 24 or the objective lens 17.

It is also possible to embed the optical window 27 into the pad 1.

Figure 17:
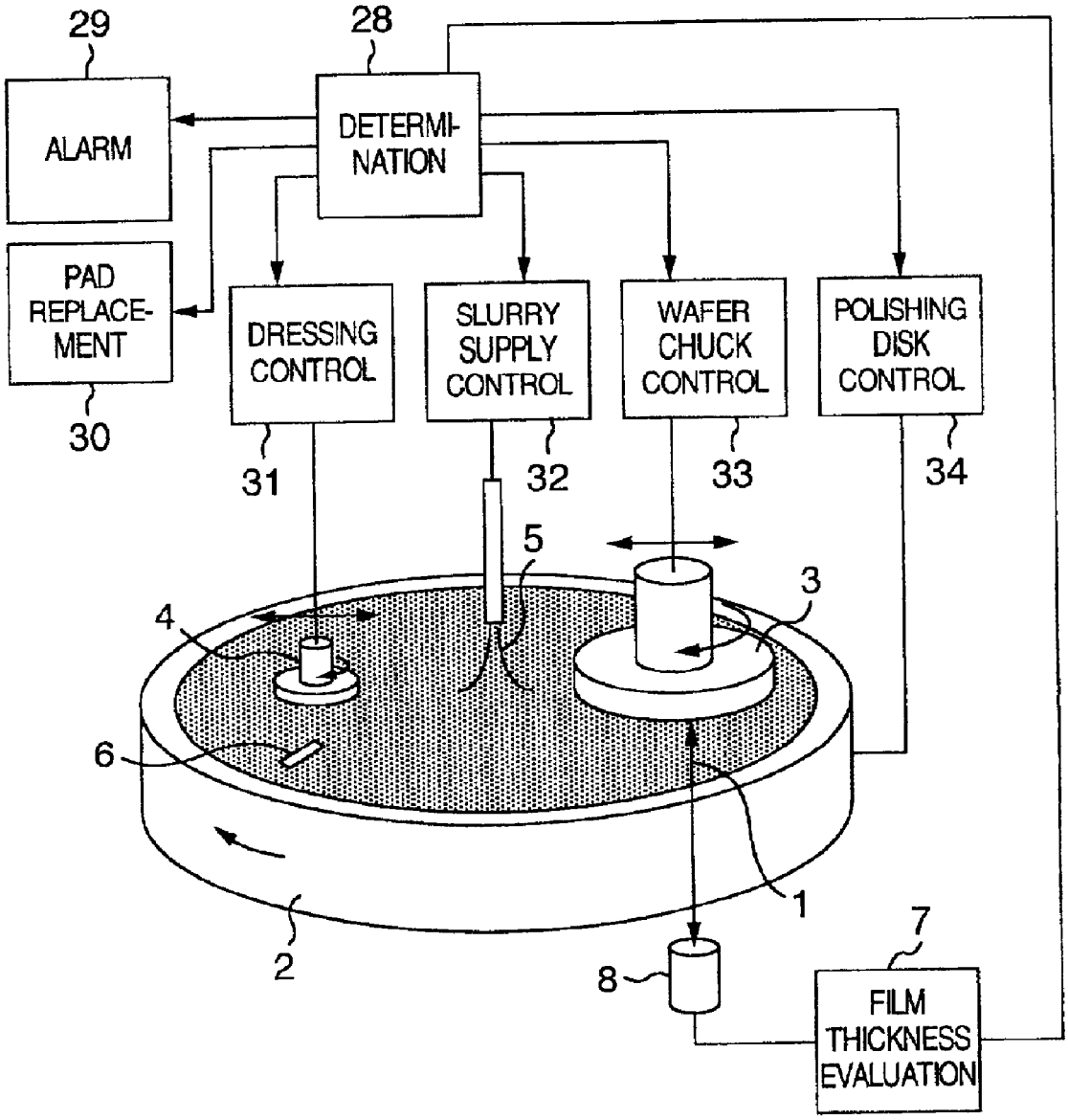
FIG. 17 is a constitutional diagram schematically showing a concrete example of a polishing process in an embodiment of a method and apparatus for manufacturing a semiconductor device according to the present invention.

Referring to FIG. 17, there is shown a wafer polishing process of an embodiment of a method and an apparatus for manufacturing a semiconductor device according to the present invention, comprising a film thickness evaluation data determination unit 28, an alarm 29, a pad replacement unit 30, a dressing control unit 31, a slurry supply control unit 32, a wafer chuck control unit 33, and a polishing disk control unit 34, with components corresponding to those in the previous drawings designated by identical reference numerals to omit overlapped descriptions.

In this embodiment, a layer insulating film on a wafer surface is polished by using the polishing machine (CMP polishing processing machine) with the endpoint detection method and its apparatus according to the present invention set forth in the above.

In this diagram, during polishing processing of a layer insulating film on a wafer surface with a wafer 18 (not shown) held by a wafer chuck 3, a detection result of a detection unit 8 is evaluated by a film thickness evaluation unit 7 and film thickness evaluation data obtained as a result of the evaluation is supplied to the film thickness evaluation data determination unit 28. The film thickness evaluation data determination unit 28 determines a processing condition of the CMP polishing processing machine on the basis of the film thickness evaluation data and controls the alarm 29, the pad replacement unit 30, the dressing control unit 31, the slurry supply control unit 32, the wafer chuck control unit 33, and the polishing disk control unit 34.

After the film thickness of the layer insulating film on the wafer surface gets equal to a predetermined value and the film surface is smoothed as described in FIG. 4 and FIG. 5, the film thickness evaluation data determination unit 28 determines it on the basis of the film thickness evaluation data from the film thickness evaluation unit 7 and drives the alarm 29. In response to this, the alarm 29 generates an alarm to notify an operator of the wafer reaching the endpoint of polishing processing. Furthermore, it is also possible to stop the rotation of the polishing disk 2 with this and to release the wafer from the pressed condition toward the pad 1 by lifting the wafer chuck 3 to terminate the polishing processing.

Figure 18:
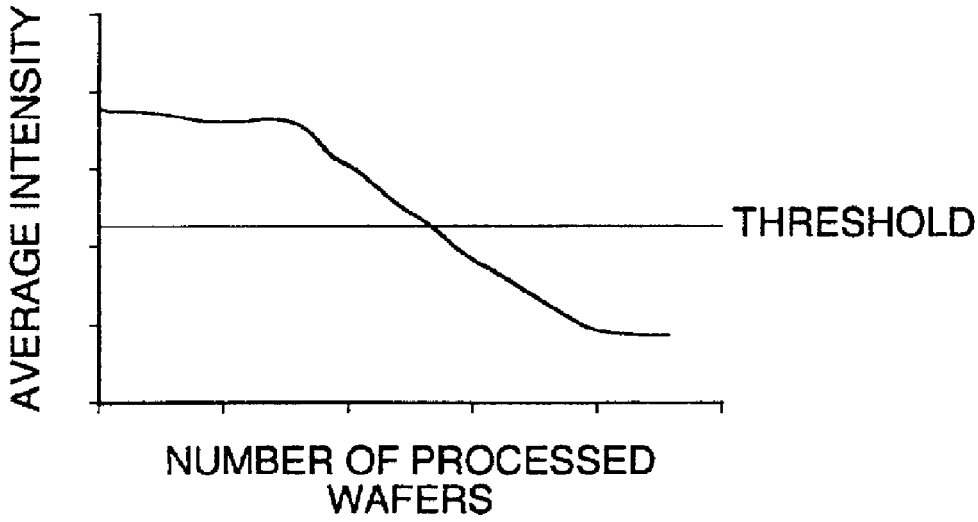
FIG. 18 is a diagram showing an example of a relationship between the number of polished wafers and an average intensity of a detected light in the polishing processing machine according to the present invention.

In addition, the film thickness evaluation data determination unit 28 is capable of processing the film thickness evaluation data from the film thickness evaluation unit 7 and determines the condition of the pad 1. Therefore, the film thickness evaluation unit 7 determines a temporal average intensity of the reflected light (reflected UV light) from the wafer on the basis of the detection result from the detection unit 8 and the film thickness evaluation data determination unit 28 evaluates a variation of the average intensity relative to the number of wafers completed to be polished and compares it with a preset threshold value as shown in FIG. 18. Then, if the average intensity is lower than the threshold value, it determines that the pad 1 is deteriorated and drives the pad replacement unit 30. With this, the pad replacement unit 30 performs an alarm generation or the like operation to notify the operator of a need for pad replacement.

Furthermore, the film thickness evaluation unit 7 calculates a polishing rate with evaluating a variation period of the detected intensity as shown in FIG. 4 or FIG. 5 (or a polishing time up to a predetermined film thickness) on the basis of the detected intensity detected by the detection unit 8, and on the calculation result the film thickness evaluation data determination unit 28 determines the surface condition of the pad 1 and the polishing condition of the layer insulating film on the wafer surface (if the polishing rate is decreased, the period of the detected intensity or the above polishing time is extended). Then, the film thickness evaluation data determination unit 28 operates the dressing control unit 31 on the basis of the determination result to optimize dressing conditions such as the pushing pressure (dressing pressure), the number of revolutions, and rocking motion of the dresser 4 on the basis of the determination result so as to prevent a decrease of the polishing rate.

Figure 19:
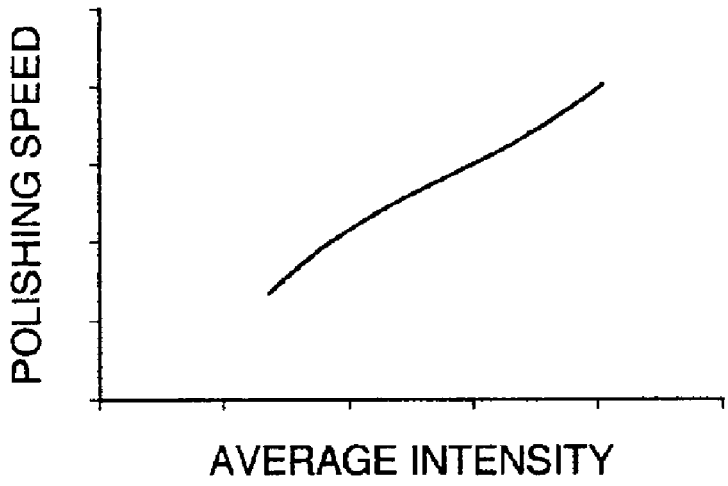
FIG. 19 is a diagram showing an example of a relationship between a polishing speed and an average intensity of a detected light in the polishing processing machine according to the present invention.

There is a relationship between the temporal average intensity of the detected reflected light or reflected UV light and the polishing rate as shown in FIG. 19; if the average intensity is low, the polishing rate is decreased. Therefore, in FIG. 17, the film thickness evaluation data determination unit 28 determines the polishing rate on the basis of the film thickness evaluation data of the average intensity from the film thickness evaluation unit 7, controls the supply of the slurry 5 by operating the slurry supply control unit 32, controls the pushing pressure toward the pad 1 of the wafer by operating the wafer chuck control unit 33, or changes the rotation speed of the polishing disk 2 by controlling the polishing disk control unit 34 so that the optimum polishing rate is set.

In addition, if the wafer chuck control unit 33 is capable of controlling a pressure distribution to the pad 1 on the wafer surface, the detection window 6 is provided as shown in FIG. 11 or FIG. 12 to detect a film thickness distribution in the radial direction of the layer insulating film on the surface of the wafer by which the film thickness evaluation data determination unit 28 controls the wafer chuck control unit 33 according to the detection result, thereby enabling polishing processing with the layer insulating film having an even thickness on its almost entire surface. Accordingly, this makes it possible to achieve uniform polishing processing of the layer insulating film on the wafer surface.

In the embodiment shown in FIG. 17, the determination method to a feedback destination has been described only as an example thereof and the determination method is not limited to the above. The determination and the operation performed as a result thereof can be manually performed by the device operator or can be automatically performed.

As set forth hereinabove, according to the present invention, it is possible to detect an endpoint very accurately in polishing processing and to control the polishing processing very precisely.

Furthermore, a process throughput can be improved by incorporating the processor unit for detecting the endpoint into the polishing process. For example, in a method of manufacturing a semiconductor device on a wafer or in a CMP polishing process in a manufacturing line, the endpoint detection can be performed very accurately, thereby improving the process throughput.

The invention may be embodied in other specific forms without departing from the spirit or essential characteristics thereof. The present embodiment is therefor to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of detecting an endpoint of polishing processing, comprising the steps of:

simultaneously irradiating lights having different wavelengths from one another onto an optically transparent thin film formed on a surface of a wafer on which patterns are formed under polishing processing;

separately detecting interference lights of said respective lights having the different wavelengths caused by interference between lights reflected from a surface of said thin film and surfaces of said patterns formed on said wafer with the lights of the different wavelengths which are irradiated; and detecting the endpoint of polishing processing of said film on the basis of a relationship between intensities of the separately detected interference lights of the different wavelengths.

2. A method of detecting an endpoint of polishing processing according to claim 1, wherein said endpoint of polishing processing is detected on the basis of an intensity ratio of said detected interference lights of different wavelengths.

3. A method of detecting an endpoint of polishing processing according to claim 1, wherein a white light provides the lights of the different wavelengths.

4. A method of detecting an endpoint of polishing processing according to claim 1, wherein in the step of detecting the endpoint, the endpoint is detected on the basis of a spectral intensity of the detected interference lights of the different wavelengths.

5. A method of detecting an endpoint of polishing processing according to claim 1, wherein a UV light provides the lights of the different wavelengths.

6. A method of manufacturing a semiconductor device, comprising the steps of:

forming an optically insulating film on a surface of a wafer on which patterns are formed;

attaching the wafer having the insulating film formed on its surface to a polishing processing machine;

starting polishing processing of the wafer attached to the polishing processing machine;

simultaneously irradiating lights having different wavelengths from one another onto the surface of said wafer under polishing processing;

detecting interference lights of said respective lights having the different wavelengths generated by interference between lights reflected from a surface of said insulating film and surfaces of said patterns formed on said wafer with the lights of the different wavelengths which are irradiated;

detecting an endpoint of polishing processing on the film by comparing at least an intensity of the separately detected interference lights of the different wavelengths;

stopping polishing processing of said wafer on which the endpoint is detected;

detaching the wafer whose polishing processing is stopped from said polishing processing machine; and forming a new wiring pattern on said insulating film of the wafer detached from said polishing processing machine.

7. A method of manufacturing a semiconductor device according to claim 6, wherein a polishing rate of the film is evaluated on the basis of the intensities of said detected interference lights of the different wavelengths so as to change dressing conditions of a dresser to a pad used for polishing processing on the basis of the evaluation result.

8. A method of manufacturing a semiconductor device according to claim 7, wherein said dressing conditions include at least one of a dressing pressure, the number of revolutions, and a rocking motion period of said dresser and a type of working tool used for dressing.

9. A method of manufacturing a semiconductor device according to claim 6, wherein the detecting an endpoint of polishing processing on the film by comparing at least an intensity of the detected interference lights of the different wavelengths includes detecting on the basis of a relationship between intensities of the detected interference lights of the different wavelengths.

10. A method of manufacturing a semiconductor device according to claim 6, wherein the detecting an endpoint of polishing processing is detected on the basis of an intensity ratio of the detected interference lights of different wavelengths.

11. A method of manufacturing a semiconductor device according to claim 6, wherein a white light provides the lights of the different wavelengths.

12. A method of manufacturing a semiconductor device according to claim 6, wherein a UV light provides the lights of the different wavelengths.

* * * * *